US011732199B2

(12) United States Patent
Oud

(10) Patent No.: US 11,732,199 B2
(45) Date of Patent: Aug. 22, 2023

(54) CRACKING FURNACE SYSTEM AND METHOD FOR CRACKING HYDROCARBON FEEDSTOCK THEREIN

(71) Applicant: TECHNIP ENERGIES FRANCE, Nanterre (FR)

(72) Inventor: Peter Oud, Zoetermeer (NL)

(73) Assignee: TECHNIP ENERGIES FRANCE, Nanterre (FR)

( * ) Notice: Subject to any disclaimer, the term of this patent is extended or adjusted under 35 U.S.C. 154(b) by 0 days.

(21) Appl. No.: 16/623,060

(22) PCT Filed: Jun. 15, 2018

(86) PCT No.: PCT/EP2018/065998
§ 371 (c)(1),
(2) Date: Dec. 16, 2019

(87) PCT Pub. No.: WO2018/229267
PCT Pub. Date: Dec. 20, 2018

(65) Prior Publication Data

US 2020/0172814 A1 Jun. 4, 2020

(30) Foreign Application Priority Data

Jun. 16, 2017 (EP) ..... 17176502

(51) Int. Cl.
*C10G 9/18* (2006.01)
*C10G 9/00* (2006.01)
*C10G 9/36* (2006.01)

(52) U.S. Cl.
CPC ..... *C10G 9/18* (2013.01); *C10G 9/002* (2013.01); *C10G 9/36* (2013.01)

(58) Field of Classification Search
CPC ..... C10G 9/002; C10G 9/18; C10G 9/36
See application file for complete search history.

(56) References Cited

U.S. PATENT DOCUMENTS 4,479,869 A * 10/1984 Petterson ..... C10G 9/36 208/130
4,721,604 A * 1/1988 Simonetta ..... B01J 6/008 422/198

(Continued)

FOREIGN PATENT DOCUMENTS

BR 8605948 A 9/1987
JP S60130679 A 7/1985

(Continued)

OTHER PUBLICATIONS

International Search Report issued in PCT/EP2018/065998, dated Jul. 27, 2018.

(Continued)

*Primary Examiner* — Prem C Singh
*Assistant Examiner* — Brandi M Doyle
(74) *Attorney, Agent, or Firm* — Locke Lord LLP; Alan B. Clement; Alicia J. Carroll

(57) ABSTRACT

Cracking furnace system for converting a hydrocarbon feedstock into cracked gas comprising a convection section, a radiant section and a cooling section, wherein the convection section includes a plurality of convection banks configured to receive and preheat hydrocarbon feedstock, wherein the radiant section includes a firebox comprising at least one radiant coil configured to heat up the feedstock to a temperature allowing a pyrolysis reaction, wherein the cooling section includes at least one transfer line exchanger.

16 Claims, 8 Drawing Sheets

(56) References Cited

U.S. PATENT DOCUMENTS

| | | | | |
|---|---|---|---|---|
| 6,312,652 | B1 * | 11/2001 | Duncan | B01J 8/062 585/920 |
| 2008/0286707 | A1 * | 11/2008 | Panesar | F23L 7/007 431/10 |
| 2014/0121432 | A1 | 5/2014 | Wang et al. | |
| 2015/0291484 | A1 * | 10/2015 | Kloth | C10G 9/00 585/640 |
| 2016/0168478 | A1 * | 6/2016 | Spicer | B08B 3/00 134/20 |

FOREIGN PATENT DOCUMENTS

| | | | |
|---|---|---|---|
| JP | S62059226 | A | 3/1987 |
| JP | S62148591 | A | 7/1987 |
| JP | H09249591 | A | 9/1997 |
| KR | 19910008564 | B1 | 10/1991 |
| KR | 20140056066 | A | 5/2014 |
| RU | 2537440 | C1 | 1/2015 |
| RU | 182274 | U1 | 8/2018 |
| WO | WO 2011094169 | * | 8/2011 |
| WO | 2012/015494 | A2 | 2/2012 |

OTHER PUBLICATIONS

Korean Office Action dated Sep. 8, 2021, issued during the prosecution of Korean Patent Application No. 1020207000936, with translation.

Russian Office Action dated Aug. 20, 2021, issued during the prosecution of Russian Patent Application No. RU 2019142030-05.

Japanese Office Action dated Jan. 4, 2022, issued during the prosecution of Japanese Patent application No. JP2019-569795, 6 pages.

Brazilian Office Action dated Jul. 7, 2022, issued during the prosecution of Brazilian Patent Application No. BR 112019026847.2, 7 pages.

Japanese Office Action dated Jul. 19, 2022, issued during the prosecution of Japanese Patent Application No. JP 2019-569795, 3 pages.

* cited by examiner

CRACKING FURNACE SYSTEM AND METHOD FOR CRACKING HYDROCARBON FEEDSTOCK THEREIN

CROSS REFERENCE TO RELATED APPLICATIONS

This application is a U.S. National Phase Application filed under 35 U.S.C. § 371, based on International PCT Patent Application No. PCT/EP2018/065998, filed Jun. 15, 2018, which application claims priority to European Patent Application No. 17176502.7 filed on Jun. 16, 2017. The contents of these applications are incorporated herein by reference in their entirety.

The invention relates to a cracking furnace system.

A conventional cracking furnace system, as is for example disclosed in document U.S. Pat. No. 4,479,869, generally comprises a convection section, in which hydrocarbon feedstock is preheated and/or partly evaporated and mixed with dilution steam to provide a feedstock-dilution steam mixture. The system also comprises a radiant section, including at least one radiant coil in a firebox, in which the feedstock-dilution steam mixture from the convection section is converted into product and by-product components at high temperature by pyrolysis. The system further comprises a cooling section including at least one quench exchanger, for example a transfer line exchanger, configured to quickly quench the product or cracked gas leaving the radiant section in order to stop pyrolysis side reactions, and to preserve the equilibrium of the reactions in favour of the products. Heat from the transfer line exchanger can be recovered in the form of high pressure steam.

A drawback of the known systems is that a lot of fuel needs to be supplied for the pyrolysis reaction. In order to reduce this fuel consumption, the firebox efficiency, the percentage of the released heat in the firebox that is absorbed by the radiant coil, can be significantly increased. However, the heat recovery scheme in the convection section of a conventional cracking furnace system with increased firebox efficiency has only limited capabilities to heat up the hydrocarbon feedstock to reach the optimum temperature to enter the radiant section. As a result, reducing fuel consumption, and thus reducing $CO_2$ emission, is hardly possible within a conventional cracking furnace system.

It is an aim of the present invention to solve or alleviate the above-mentioned problem. Particularly, the invention aims at providing a more efficient system with a reduced need for energy supply, and consequently, a reduced emission of $CO_2$.

To this aim, according to a first aspect of the present invention, there is provided a cracking furnace system characterized by the features of claim 1. In particular, the cracking furnace system for converting a hydrocarbon feedstock into cracked gas comprises a convection section, a radiant section and a cooling section. The convection section includes a plurality of convention banks configured to receive and preheat hydrocarbon feedstock. The radiant section includes a firebox comprising at least one radiant coil configured to heat up the feedstock to a temperature allowing a pyrolysis reaction. The cooling section includes at least one transfer line exchanger as a heat exchanger. In an inventive way, the system is configured such that the feedstock is preheated by the transfer line exchanger before entry into the radiant section.

The transfer line exchanger is a heat exchanger arranged to cool down or quench the cracked gas. The recovered heat or waste heat of this quenching can then be recovered and used in the cracking furnace system, for example for steam generation as is commonly known in the prior art. Heating the feedstock in the cooling section, according to the invention, using waste heat of the cracked gas in the transfer line exchanger, instead of heating the feedstock in the convection section, as is done in prior art systems, can allow a firebox efficiency to be increased significantly, leading to a fuel gas reduction of up to, or even exceeding, approximately 20%. The firebox efficiency is the ratio between the heat absorbed by the at least one radiant coil for the conversion of the hydrocarbon feedstock to the cracked gas by means of pyrolysis, which is an endothermic reaction, and the heat released by the combustion process in the combustion zone, based on a lower heating value of 25° C. This definition corresponds to the formula for fuel efficiency 3.25 as defined in API Standard 560 (Fired Heaters for General Refinery Service). The higher this efficiency, the lower the fuel consumption, but also the lower the heat that is available for feedstock preheating in the convection section. The preheating of the feedstock in the cooling section can overcome this obstacle. So, in the cracking furnace system according to the invention, there is a first feedstock preheating step and a second feedstock preheating step. The first feedstock preheating step includes preheating hydrocarbon feedstock by hot flue gasses of the cracking furnace system, for example in one of the plurality of convection banks in the convection section. The preheating also comprises partial evaporation in case of liquid feedstock and superheating in case of gaseous feedstock. The second feedstock preheating step includes further preheating of the feedstock by waste heat of cracked gas of the cracking furnace system before entry of the feedstock into the radiant section of the cracking furnace system. The second feedstock preheating step is performed using a transfer line exchanger in the cooling section. The optimum inlet temperature of the feedstock into the radiant section is determined by the thermal stability of the feedstock, as is known to the person skilled in the art. Ideally the feedstock enters the radiant section at a temperature just below the point where the pyrolysis reaction starts. If the feedstock inlet temperature is too low, additional heat is required to heat up the feedstock in the radiant section, increasing the heat required to be supplied in the radiant section and the corresponding fuel consumption. If the feedstock inlet temperature is too high the pyrolysis may already start in the convection section, which is undesirable, as the reaction is associated with the formation of cokes on the internal tube surface, which can not be removed easily in the convection section during decoking. An additional advantage of this inventive cracking furnace system is that fouling by condensation of heavy (asphaltenic) tails is hardly possible in the transfer line exchanger according to the invention. In the case of gas-to-boiling steam heat transfer, for example when the transfer line exchanger is configured to generate saturated steam as in prior art systems, the boiling water has a heat transfer coefficient that is magnitudes higher than that of the gas. This results in the wall temperature being very close to that of the temperature of the boiling water. The temperature of the boiler water in cracking furnaces is typically around 320° C. and the wall temperature at the cold side of the exchanger is only marginally above this temperature for an extensive part of the cold end of the exchanger, while the dew point of the cracked gas is above 350° C. for most of the liquid feedstock, resulting in condensation of heavy tail components on the tube surface and fouling of the equipment. For this reason, the exchanger needs to be cleaned periodically. This is partly achieved during the decoking of the radiant coil, but at regular intervals the furnace has to be taken out of operation for mechanical cleaning of the transfer line exchanger. This can take several days as it does not only involve hydro-jetting of the exchanger but also controlled slow cooling down and heating up of the furnace to avoid damage. In case of gas-to-gas heat transfer, as in the present system of the invention, both heat transfer coefficients are of equal magnitude and the wall temperature of the transfer line exchanger is a lot higher than in the case of gas-to-boiling water heat exchange, the wall temperature being roughly the average value of the two media on each side of the wall. In the system according to the invention, the wall temperature is expected to be around 450° C. on the coldest part and increasing quickly to around 700° C. in the hotter part. This means that the hydrocarbon dew point is exceeded throughout the exchanger at all times and that condensation can not occur.

In a preferred embodiment, the convection section can comprise a boiler coil configured to generate saturated steam. The boiler coil can generate steam such that any waste heat in the flue gas which is not used for the preheating of the feedstock can be recovered by generating steam. This increases the overall furnace efficiency. In fact, the system according to this preferred embodiment can allow a change in the heat recovery of the system by partly diverting the heat in the effluent to the preheating of the feedstock in order to reach the optimum temperature of the feedstock before entry into the radiant section, while at the same time the heat in the flue gas is diverted to produce high pressure steam. More heat can be diverted to the heating of the feedstock than is diverted to the generation of saturated high pressure steam, which can reduce high pressure steam production in favour of increased feedstock heating. Said boiler coil can advantageously be located in a bottom part of the convection section. The temperature in the bottom area of the convection section being higher than in the top area of the convection section, this location can provide a relatively high efficiency in the heating of the boiler water. At the same time, the boiler coil can protect high pressure steam super heater banks in the convection section from overheating.

The convection section can preferably also be configured for mixing said hydrocarbon feedstock with a diluent providing a feedstock-diluent mixture, wherein the transfer line exchanger is configured to preheat the feedstock-diluent mixture before entry into the radiant section. The diluent can preferably be steam. Alternatively, methane can be used as diluent instead of steam. The mixture can also be superheated in the convection section. This is to ensure that the feedstock mixture does not contain any droplets anymore. The amount of superheat must be enough to make sure that the dew point is exceeded with sufficient margin to prevent condensation of the diluent or the hydrocarbons. At the same time, decomposition of the feedstock and coke formation in the convection section, as well as in the transfer line exchanger where the risk of coke formation is still higher due to the higher temperature, can be prevented. Moreover, as the specific heats of both the feedstock-diluent mixture and the cracked gas are very similar, the resulting heat flows are also similar on both sides of the walls of the heat exchanger, i.e. the transfer line exchanger. This means that the heat exchanger can run with practically the same temperature difference throughout the exchanger from cold side to hot side. This is advantageous both from a process point of view as from a mechanical point of view.

The system can further comprise a secondary transfer line exchanger, wherein the secondary transfer line exchanger is configured to generate saturated high pressure steam. Depending on the firebox efficiency and thus on the available heat in the cooling section, a secondary transfer line exchanger can be placed in series after the main transfer line exchanger to further cool down the cracked gas from the radiant section. While the main transfer line exchanger is configured to heat the feedstock before entry into the radiant section, the secondary transfer line exchanger can be configured to partly evaporate boiler water. The system can comprise one or more secondary heat exchangers, but the main heat exchanger is always configured to preheat feedstock, rather than generate high pressure saturated steam. The system can further comprise a steam drum which is connected to the boiler coil and/or to the secondary transfer line exchanger. Boiler water can for example flow from the steam drum of the cracking furnace system to the secondary transfer line exchanger and/or to the boiler coil. In case of a system including a secondary transfer line exchanger and a boiler coil, they can both generate saturated high pressure steam in parallel. After being partly evaporated inside one of the secondary transfer line exchanger and the boiler coil, the mixture of steam and water can be redirected to the steam drum, where steam can be separated from remaining liquid water. So in comparison with prior art systems, an additional parallel circuit is created, such that boiler water can be fed from the steam drum of the cracking furnace system to a boiler coil in the convection section of the cracking furnace system, where said boiler water is partly evaporated by hot flue gasses. A mixture of water and vapour can then be returned to said steam drum.

The firebox can preferably be configured such that a firebox efficiency is higher than 40%, preferably higher than 45%, more preferably higher than 48%. As already explained above, the firebox efficiency is the ratio between the heat absorbed by the at least one radiant coil for the conversion of the hydrocarbon feedstock to the cracked gas by means of pyrolysis and the heat released by the combustion process. A normal firebox efficiency of prior art cracking furnaces lies around 40%. If we go above this, the feedstock can no longer be heated up to the optimum temperature as insufficient heat is available in the flue gas: increasing the firebox efficiency from around 40% to approximately 48% would reduce the fraction of the heat available in the convection section from approximately 50-55% to approximately 42-47%. Contrary to prior art systems, the system according to the invention can cope with this reduced availability of heat in the convection section. By raising the firebox efficiency with approximately 20% from around 40% to approximately 48%, approximately 20% of fuel can be saved. Firebox efficiency can be raised in different ways, for example by raising the adiabatic flame temperature in the firebox and/or by increasing the heat transfer coefficient of the at least one radiant coil. Raising the firebox efficiency without raising the adiabatic flame temperature has the advantage that the NOx emission does not substantially increase, as might be the case with oxy-fuel combustion or preheated air combustion, which are other ways of raising the firebox efficiency which will be discussed further on. The firebox can for example be configured such that firing is restricted to the hot side of the firebox, i.e. to the area near the bottom of the box in case of a bottom fired furnace, or to the area near the top in case of a top fired furnace. The firebox preferably has a sufficient heat transfer area, more specifically, the heat transfer surface area of the at least one radiant coil is high enough to transfer the heat required to convert feedstock to the required conversion level of the feedstock inside the at least one radiant coil, while cooling down the flue gas to a temperature at the firebox exit, or convection section entrance, that is low enough to obtain a firebox efficiency of higher than 40%, preferably higher than 45%, more preferably higher than 48%. The at least one radiant coil of the firebox preferably includes a highly efficient radiant tube, such as the swirl flow tube, as disclosed in EP1611386, EP2004320 or EP2328851, or the winding annulus radiant tube, as described in UK 1611573.5. More preferably, said at least one radiant coil has an improved radiant coil lay-out, such as a three-lane lay-out, as disclosed in US2008142411.

The convection section can advantageously comprise an economizer configured to preheat boiler feed water for the generation of saturated steam, preferably before entry of the feed water into the steam drum of the system. This can enhance the overall efficiency of the system, which is the ratio between the heat absorbed by the at least one radiant coil for the conversion of the hydrocarbon feedstock to the cracked gas by means of pyrolysis together with the heat absorbed in the convection section by the plurality of convection banks, excluding any oxidant preheater and/or fuel preheater, and the heat released by the combustion process in the combustion zone, based on a lower heating value of 25° C.

In a further embodiment of the invention, the convection section may comprise an oxidant preheater, preferably located downstream in the convection section, i.e. where the flue gas is the coldest, configured to preheat the oxidant, such as for example combustion air and/or oxygen, before introduction of said oxidant into the firebox. In this case, heat for the pyrolysis reaction in the firebox can be provided by the combustion of fuel gas and for example preheated air in the burners of the firebox. Preheating of the oxidant can raise the adiabatic flame temperature and can make the firebox more efficient.

The system may further be configured for oxygen introduction into the radiant section. Preferably a limited amount of oxygen can be introduced for example directly into the burners of the radiant section, in particular along with combustion air, to raise the adiabatic flame temperature in the radiant section, which can raise the firebox efficiency. Doing this in absence of a flue gas recirculation circuit, as is customary for full oxy-fuel combustion, which will be discussed later, can be considered as a separate invention. As an example, flue gas can normally be cooled down from the adiabatic flame temperature of approximately 1900° C. to a reference temperature of approximately 25° C. At the adiabatic flame temperature, 100% of the heat would be available in the flue gas, while at the reference temperature, no heat would be left in the flue gas. Assuming a constant specific heat over the whole temperature range, to simplify the example, cooling down from 1900° C. to 1150° C. inside the firebox is needed to reach 40% efficiency. To reach 50% efficiency, while keeping the flue gas temperature leaving the firebox at 1150° C., we need to raise the adiabatic flame temperature from 1900° C. to 2275° C., which is an increase of 375° C. This can be done by injection of pure oxygen in the burner along with the combustion air. An injection of oxygen in a weight ratio of oxygen over combustion air of approximately 7% would be sufficient to raise the firebox efficiency with 25%. This can be done by supplying oxygen at each individual burner, preferably far away from the fuel tips to minimize NOx formation, or in the combustion zone directly, for example through a wall of the firebox. The main advantage is the significantly increased firebox efficiency, which is resulting in reduced fuel gas consumption and also an equal amount of reduction of emission of the greenhouse gas CO2 to the atmosphere. Another advantage is that the required pure oxygen is limited, in comparison with full oxy-fuel combustion, combustion with oxygen as oxidant instead of combustion air, as discussed later. The injection of 7 wt % oxygen in the combustion air can increase the oxygen content from 20.7 vol % to 25.2 vo1 % and can reduce the nitrogen content from 77 vo1 % to 72.6 vol %. The higher adiabatic flame temperature may result in higher NOx production. NOx abatement measures might need to be taken, for example by the installation of a selective catalytic NOx reduction bed in the convection section or in the stack.

In a preferred embodiment, the system can additionally comprise an external flue gas recirculation circuit configured to recover at least part of the flue gas and to recirculate said flue gas to the radiant section to control flame temperature. This allows the oxygen injection in the oxidant to be increased and consequently the nitrogen concentration in the oxidant to be reduced for a given adiabatic flame temperature. The higher the oxygen concentration in the oxidant, the higher the required flue gas recirculation to maintain the same adiabatic flame temperature. In an extreme case the oxidant is pure oxygen, practically depleted of nitrogen. This is called full oxy-fuel combustion. Without nitrogen, NOx cannot be formed. As combustion on pure oxygen would raise the adiabatic flame temperature to values higher than optimal, sufficient external flue gas recirculation may preferably be added to quench the flame and maintain it at a desired temperature level. Flue gas is preferably recirculated from downstream the convection section of the system. In this way, the adiabatic flame temperature in the radiant section can be lowered. As explained above, the external flue gas recirculation is introduced to temper the adiabatic flame temperature increase resulting from an increased oxygen content in the oxidant. The higher the flue gas recirculation rate and the lower the recirculated flue gas temperature, the colder the flame and the lower the NOx formation.

The external flue gas recirculation circuit can advantageously comprise a first flue gas ejector configured to introduce oxygen into the recirculated flue gas prior to entry into the firebox. In this case, heat for the highly endothermic pyrolysis reaction in the firebox comes from the combustion of fuel gas and oxygen, preferably highly nitrogen depleted oxygen, or of fuel gas and a combination of oxygen and combustion air, in the presence of recirculated flue gas. The ejector can be placed upstream of firebox burners such that the recirculated flue gas and the oxygen are fed to the firebox in a common line. Advantageously, the ejector can create an under pressure in an external flue gas recirculation duct and can reduce power requirements for a recirculation device, such as for example an induced draft fan, which can be located downstream of the convection section of the cracking furnace system.

An advantageous embodiment of the system may further comprise a heat pump circuit including an evaporator coil located in the convection section and a condenser, wherein the heat pump circuit is configured such that the evaporator coil recovers heat from the convection section and the condenser transfers said heat to boiler feed water. Such a heat pump circuit can reduce the stack temperature with approximately 40-50° C., depending on the specific furnace feedstock composition and operating conditions. Reducing the stack temperature can then result in a rise of the overall efficiency of the system. It is known to preheat boiler feed water by recovering heat from the flue gasses to increase the overall efficiency of the system. However, especially in case of oxy-fuel combustion in the furnace firebox, waste heat of the flue gasses may not be sufficient to preheat boiler feed water directly, as the temperature of the flue gas may be below that of the boiler feed water. Boiler feed water is typically supplied directly from a deaerator at a temperature of approximately 120-130° C., while the flue gas leaving the feed preheating banks are generally below this temperature, rendering direct preheating of feed water impossible. The heat pump circuit can provide a solution to exchange heat indirectly, such that the stack temperature can be reduced further and the overall efficiency of the system can be further improved.

The heat pump circuit for preheating boiler feed water of a cracking furnace system, which can be considered as an invention on its own, can do this preheating indirectly, and without the need for an economizer in the convection section, improving overall efficiency of the system. An organic fluid circulating in the circuit can for example comprise one of butane, pentane or hexane, or any other suitable organic fluid. Moreover, as an additional advantage, the heat pump circuit can be embodied as an add-on module, such that existing cracking furnace systems can be equipped with such a heat pump circuit after installation without needing major modifications of the existing system. Additionally, the heat pump can be configured such that it can serve a plurality of cracking furnace systems, thus reducing the equipment items needed and decreasing associated costs.

According to an aspect of the invention, there is provided a method for cracking hydrocarbon feedstock in a cracking furnace system, providing one or more of the above-mentioned advantages.

The present invention will be further elucidated with reference to figures of exemplary embodiments. Therein, FIG. 1 shows a schematic representation of a first preferred embodiment of a cracking furnace system according to the invention;

It is noted that the figures are given by way of schematic representation of embodiments of the invention. Corresponding elements are designated with corresponding reference signs.

Figure 1:
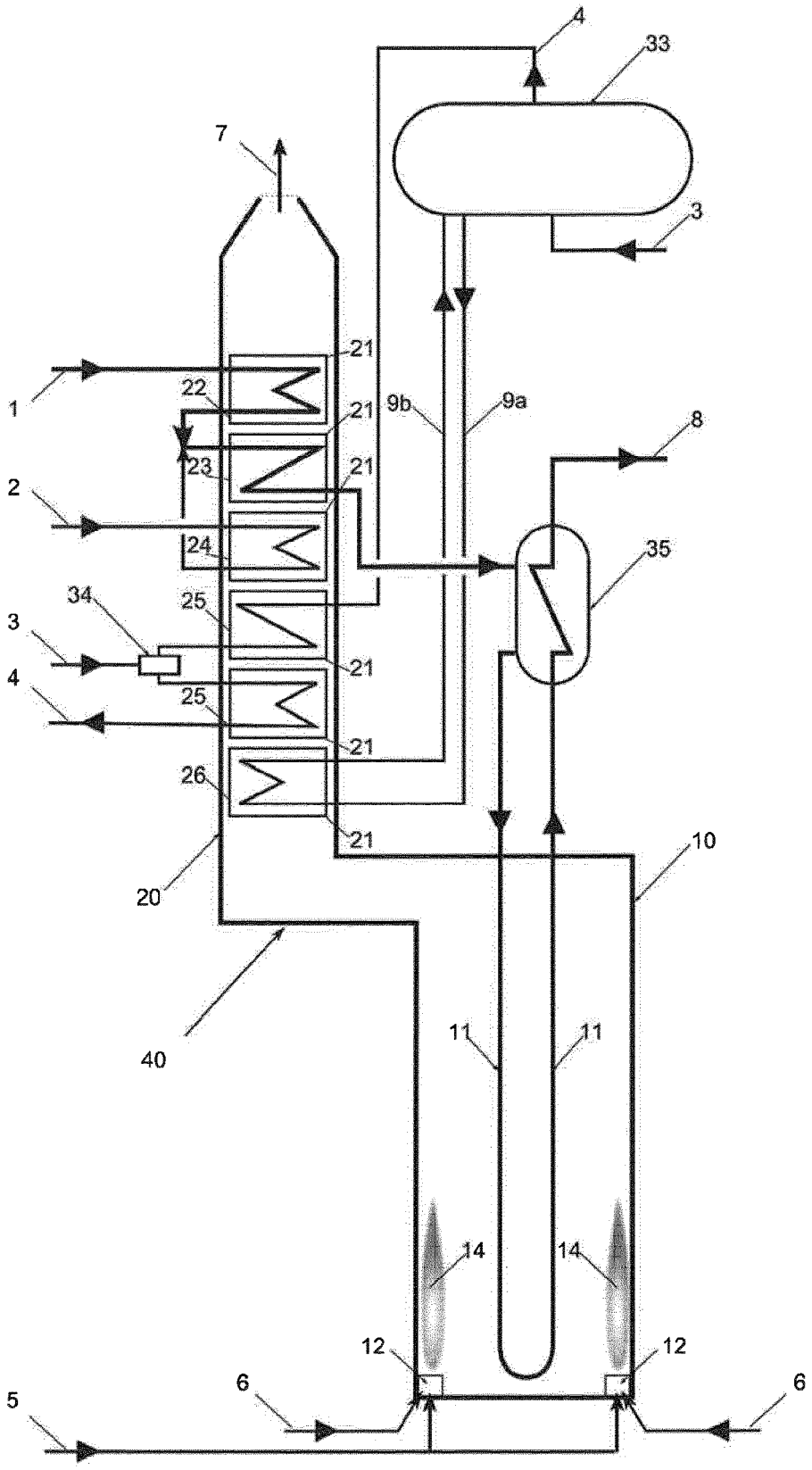

FIG. 1 shows a schematic representation of a cracking furnace system 40 according to a preferred embodiment of the invention. The cracking furnace system 40 comprises a convection section including a plurality of convection banks 21. Hydrocarbon feedstock 1 can enter a feed preheater 22, which can be one of the plurality of convection banks 21 in the convection section 20 of the cracking furnace system 40. This hydrocarbon feedstock 1 can be any kind of hydrocarbon, preferably paraffinic or naphthenic in nature, but small quantities of aromatics and olefins can also be present. Examples of such feedstock are: ethane, propane, butane, natural gasoline, naphtha, kerosene, natural condensate, gas oil, vacuum gas oil, hydro-treated or desulphurized or hydro-desulphurized (vacuum) gas oils or combinations thereof. Depending on the state of the feedstock the feed is preheated and/or partly or fully evaporated in the preheater before being mixed with a diluent, such as dilution steam 2. Dilution steam 2 can be injected directly or, alternatively, as in this preferred embodiment, dilution steam 2 can first be superheated in a dilution steam super heater 24 before being mixed with the feedstock 1. There can be a single steam injection point or multiple steam injection points, for example for heavier feedstock. The mixed feedstock/dilution steam mixture can be further heated in a high temperature coil 23 and, according to the invention, in the primary transfer line exchanger 35 to reach an optimum temperature for introduction into the radiant coil 11. The radiant coil can for example be of the swirl flow type, as disclosed in EP1611386, EP2004320 or EP2328851, or a three lane radiant coil design (as disclosed in US 2008 142411), or a winding annulus tube type (UK 1611573.5) or of any other type maintaining a reasonable run length, as known to the person skilled in the art. In the radiant coil 11 the hydrocarbon feedstock is quickly heated up to the point where the pyrolysis reaction starts so that the hydrocarbon feedstock is converted into products and by-products. Such products are amongst others hydrogen, ethylene, propylene, butadiene, benzene, toluene, styrene and/or xylenes. By-products are amongst others methane and fuel oil. The resulting mixture of a diluent such as dilution steam, unconverted feedstock and converted feedstock, which is the reactor effluent called "cracked gas", is cooled quickly in the transfer line exchanger 35, to freeze the equilibrium of the reactions in favour of the products. In an inventive way, the waste heat in the cracked gas 8 is first recovered in the transfer line exchanger 35 by heating up the feedstock or feedstock-diluent mixture before it is sent to the radiant coil 11. According to the present invention, high pressure steam can be generated in the convection section, for example by a boiler coil 26 configured to at least partly evaporate boiler water from the steam drum 33 to generate saturated high pressure steam. The boiler coil 26 can be located in a bottom part of the convection section and is connected with the steam drum 33, such that boiler water 9*a* can flow from the steam drum 33 to the boiler coil 26 and such that partly vaporized boiler water 9*b* can flow back from the boiler coil 26 to the steam drum 33 by natural circulation. Boiler feed water 3 can be delivered directly to the steam drum 33. In the steam drum 33, boiler feed water 3 is mixed with boiler water already present in the steam drum. In the steam drum 33 the generated saturated steam is separated from boiler water and can be sent to the convection section 20 to be superheated, which can be done by at least one high pressure steam super heater 25, for example by a first and a second super heater 25 in the convection section 20. Said boiler coil 26 located in a bottom part of the convection section can recover excess heat from the flue gas and can protect the downstream convection section banks, especially the at least one high pressure steam super heater bank 25, from overheating. Said at least one super heater 25 can preferably be located upstream of the dilution steam super heater 24, and preferably downstream of the boiler coil 26. To control the high pressure steam temperature, additional boiler feed water 3 can be injected into a de-super heater 34 located between a first and a second super heater 25.

The heat of reaction for the highly endothermic pyrolysis reaction can be supplied by the combustion of fuel (gas) 5 in the radiant section 10, also called the furnace firebox, in many different ways, as is known to the person skilled in the art. Combustion air 6 can for example be introduced directly into burners 12 of the furnace firebox, in which burners 12 fuel gas 5 and combustion air 6 is fired to provide heat for the pyrolysis reaction. In the combustion zones 14 in the furnace firebox, fuel 5 and combustion air 6 are converted to combustion products such as water and CO2, the so-called flue gas. The waste heat from the flue gas 7 is recovered in the convection section 20 using various types of convection banks 21. Part of the heat is used for the process side, i.e. the preheating and/or evaporation and/or superheating of hydrocarbon feed and/or the feedstock-diluent mixture, and the rest of the heat is used for the non-process side, such as the generation and superheating of high pressure steam, as described above.

Figure 2:
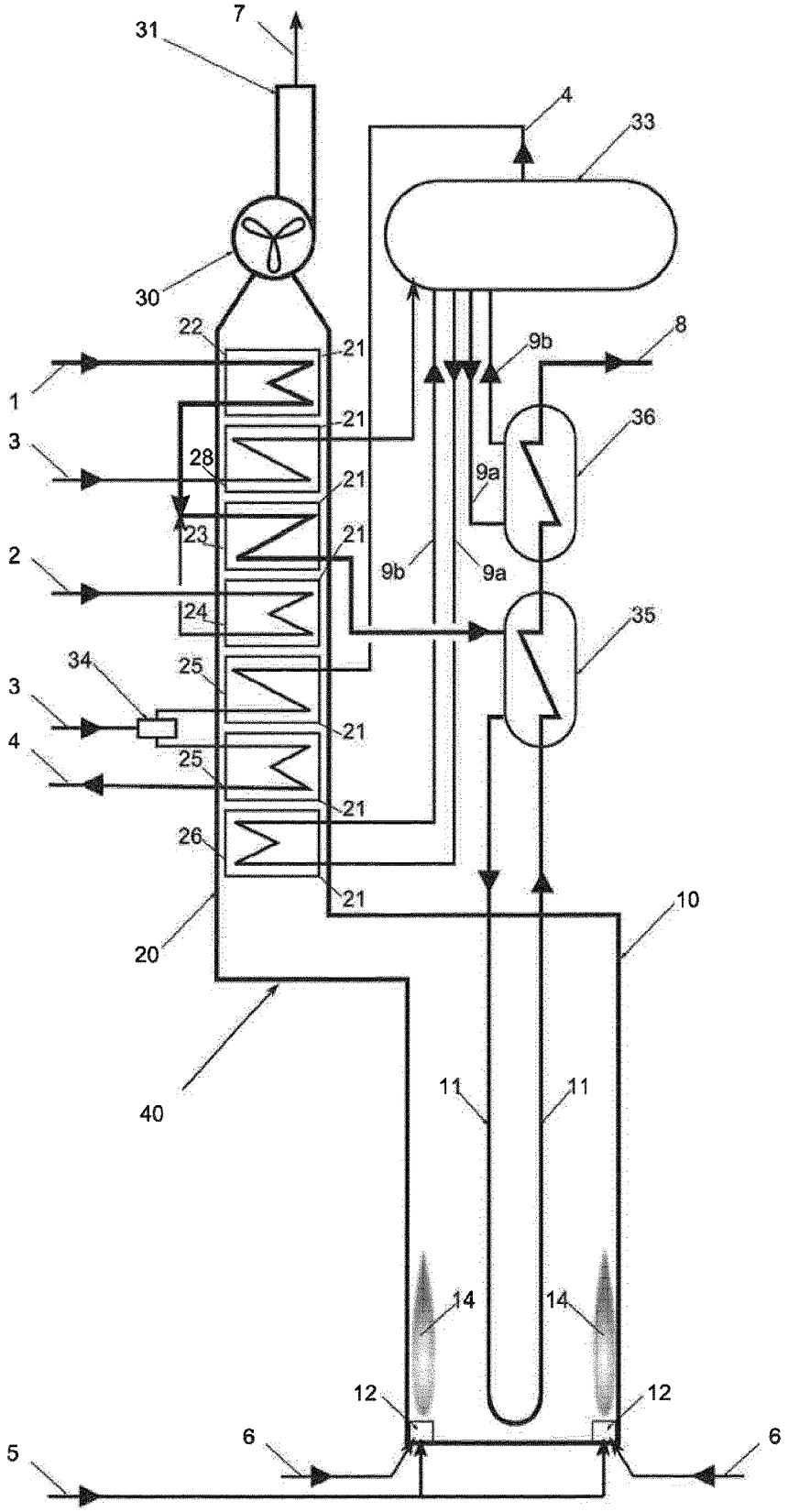
FIG. 2 shows a schematic representation of a second embodiment of a cracking furnace system according to the invention.

In one embodiment, such as illustrated in FIG. 2 showing a schematic representation of a second embodiment of a cracking furnace system, any excess heat in the cracked gas can for example be recovered in at least an additional transfer line exchanger, the secondary transfer line exchanger 36, which is configured to generate saturated high pressure steam. This steam is generated from boiler water 9*a* coming from the steam drum 33, which boiler water is partly vaporized by the secondary transfer line exchanger 36. This partly vaporized boiler water 9*b* is flowing to the steam drum 33 by natural circulation. In this way, an additional loop from and to the steam drum 33 is provided to increase high pressure steam generation and improve the overall furnace efficiency. Boiler feed water 3 can be delivered directly to the steam drum 33, as in FIG. 1, or can first be preheated, for example by excess heat available in the convection section 20 not required by the boiler coil 26. Thereto, a further convection bank 21, for example an economizer 28, can be added to the furnace convection section 20. This convection bank 28 can be configured to preheat the boiler feed water 3 before entering the steam drum 33, with the purpose to raise overall furnace efficiency and provide a more cost-effective convection section. The embodiment in FIG. 2 further shows an induced draft fan 30, also called a flue gas fan, and a stack 31 located at a downstream end of the convection section to evacuate the flue gas from the convection section 20.

With the new inventive arrangement, as shown in FIGS. 1 and 2, the amount of non-process duty, i.e. the duty recovered in the cracked gas and the convection section for the high pressure steam generation, can be reduced independently of the amount of process duty required to preheat the dilution steam hydrocarbon mixture to the optimum temperature to enter the radiant coil. This means that the firebox efficiency can be increased from 40% for a conventional scheme to as high as 48% for the new scheme as is shown in FIGS. 1 and 2, reducing the fuel consumption by approximately 17%. The reduced fuel consumption also reduces the flue gas flow rate and the associated convection section duty with roughly 17%. The new scheme allows this heat to be prioritized for the process usage at the cost of the non-process usage, resulting in an optimized process inlet temperature for the radiant coil, but with a lower high pressure steam production. Maintaining an optimized radiant coil inlet temperature is important as a lower inlet temperature of the feedstock would raise the radiant duty and lower the firebox efficiency and raise the fuel consumption, while a higher inlet temperature could result in conversion of feedstock inside the convection section and associated deposition of cokes on the internal surface convection section tubes. This coke deposition cannot be removed during the regular decoking cycle for the removal of cokes in the radiant coil as the tube temperature is too low for combustion of the cokes in the convection section, ultimately requiring a prolonged and costly furnace shutdown for cutting the affected tubes in the convection section and the mechanical removal of the cokes.

The combustion in the furnace firebox 10 can be done by means of bottom burners 12 and/or sidewall burners and/or by means of roof burners and/or sidewall burners in a top fired furnace. In the exemplary embodiment of the furnace 10 as shown in FIG. 2, firing is restricted to the lower part of the firebox by using bottom burners 12 only. This can raise firebox efficiency and can drastically reduce fuel gas consumption by up to approximately 20% compared with a conventional scheme. A high firebox efficiency can be achieved among others using for instance only bottom burners (as shown) or a number of rows of side wall burners placed close to the bottom in case of bottom firing, or by using only roof burners or a number of rows of side wall burners placed very close to the roof in case of top firing. Making the firebox taller or placing more efficient radiant coils are other examples to reach this objective. As the heat distribution in this case is rather focused on part of the radiant coil, the local heat flux is increased, reducing run length. To counteract this effect, the application of heat transfer enhancing radiant coil tubes, such as for example swirl flow tube types or winding annulus radiant tube types may be required in the radiant coil in order to maintain a reasonable run length. Other means to gain better performance, such as a three lane coil design, can also be used to increase run length, either separately or in combination with other means. Advantageously, this embodiment does not substantially have issues with NOx emissions, compared with a conventional furnace as the adiabatic flame temperature is not increased due to oxy-fuel combustion or air preheat.

Figure 3:
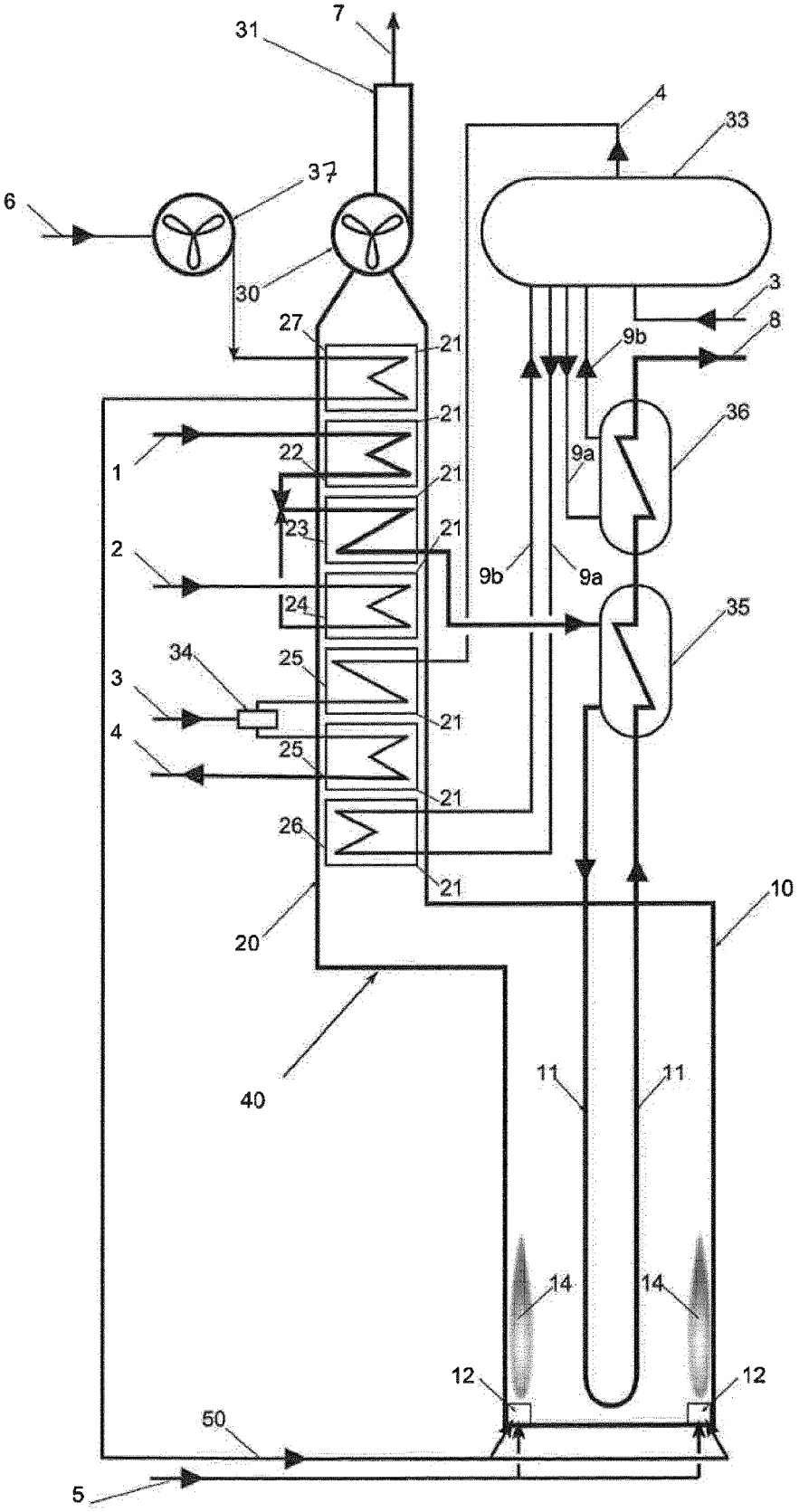
FIG. 3 shows a schematic representation of a third embodiment of a cracking furnace system according to the invention.

FIG. 3 shows a schematic representation of a third embodiment of a cracking furnace system. In this embodiment, heat for the pyrolysis reaction in the furnace firebox 10 is provided by fuel gas 5 and preheated combustion air 50 fired in the burners 12. Combustion air 6 can be introduced via a forced draft fan 37, and can then be heated up in the convection section 20, for example by a convection bank embodied as an air preheater 27 located to a downstream side of the convection section 20, preferably downstream all the other convection section banks in the convection section. Preheating of the combustion air can raise the adiabatic flame temperature and make the firebox even more efficient than the system presented in FIG. 2. Fuel gas reduction in excess of 25% as compared with conventional schemes is feasible. However, the higher adiabatic flame temperature may also raise the NOx emission, depending on the extent of the combustion air preheat. Depending on the environmental regulations on maximum allowable NOx emissions, this may require NOx abatement measures to be taken, for example by installing a selective catalytic NOx reduction bed in the convection section 20. As the firebox efficiency can be higher than in the system shown in FIG. 2, the convection section duty is lower and excess heat in the convection section for preheating boiler feed water might no longer be available as the firebox efficiency is increased. Eventually the economizer can become redundant and the boiler feed water can be sent to the steam drum without being preheated in an economizer, as is shown in FIG. 3.

Figure 4:
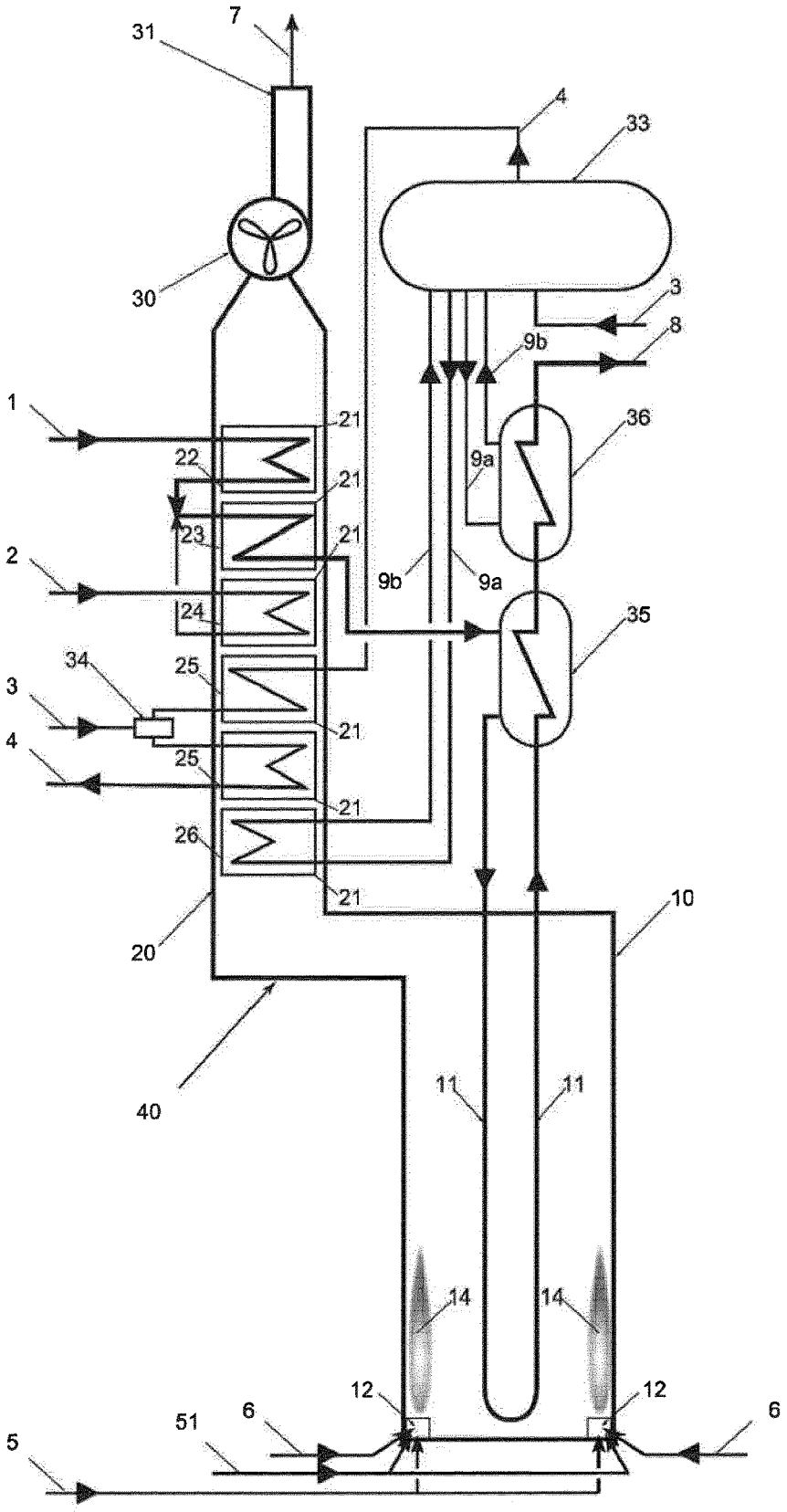
FIG. 4 shows a schematic representation of a fourth embodiment of a cracking furnace system according to the invention.

FIG. 4 shows a schematic representation of a fourth embodiment of a cracking furnace system. In this embodiment, heat for the pyrolysis reaction in the furnace firebox 10 is provided by fuel gas 5, combustion air 6 and highly nitrogen depleted combustion oxygen 51 fired in the burners 12. Introduction of oxygen in the combustion zone 14 can also raise the adiabatic flame temperature as an alternative method to the scheme presented in FIG. 3. Also with this scheme, fuel gas reduction in excess of 25% as compared with conventional schemes is feasible. However, the higher adiabatic flame temperature may also raise the NOx emission, depending on the extent of the oxygen injection. Depending on the environmental regulations on maximum allowable NOx emissions, this may require NOx abatement measures to be taken, for example by installing a selective catalytic NOx reduction bed in the convection section 20.

Figure 5:
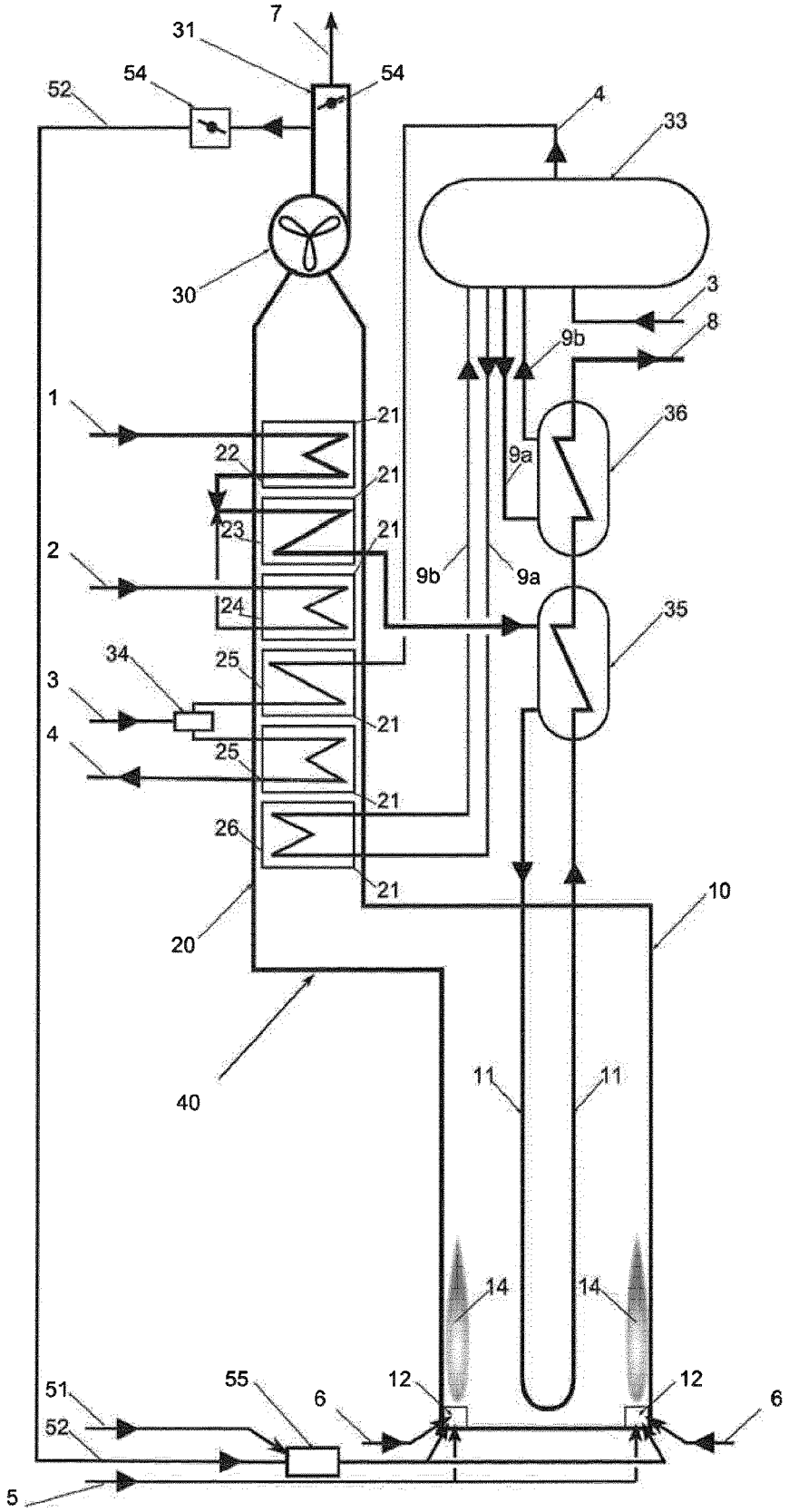
FIG. 5 shows a schematic representation of a fifth embodiment of a cracking furnace system according to the invention

FIG. 5 shows a schematic representation of a fifth embodiment of a cracking furnace system. In this embodiment, heat for the pyrolysis reaction in the furnace firebox 10 is provided by fuel (gas) 5, combustion air 6 and highly nitrogen depleted combustion oxygen 51 fired in the burners 12 in the presence of externally recirculating flue gas 52. The combustion oxygen 51 can be mixed with recirculated flue gas 52 upstream of the burners 12 in a common line to the burners 12 using an ejector 55. To obtain the recirculated flue gas 52, the flue gas exiting the convection section 20 can be split by for example a flue gas splitter 54 into produced flue gas 7 and flue gas 52 for external recirculation. The produced flue gas 7 can be evacuated through a stack 31 using an induced draft fan 30. The same fan 30 can be configured to recirculate the flue gas externally to the burners 12. Alternatively, the fan 30 may be embodied as two or more fans, depending on parameters such as pressure drop difference of a downstream system, e.g. stack 31 or flue gas recirculation circuit 52.

Figure 6:
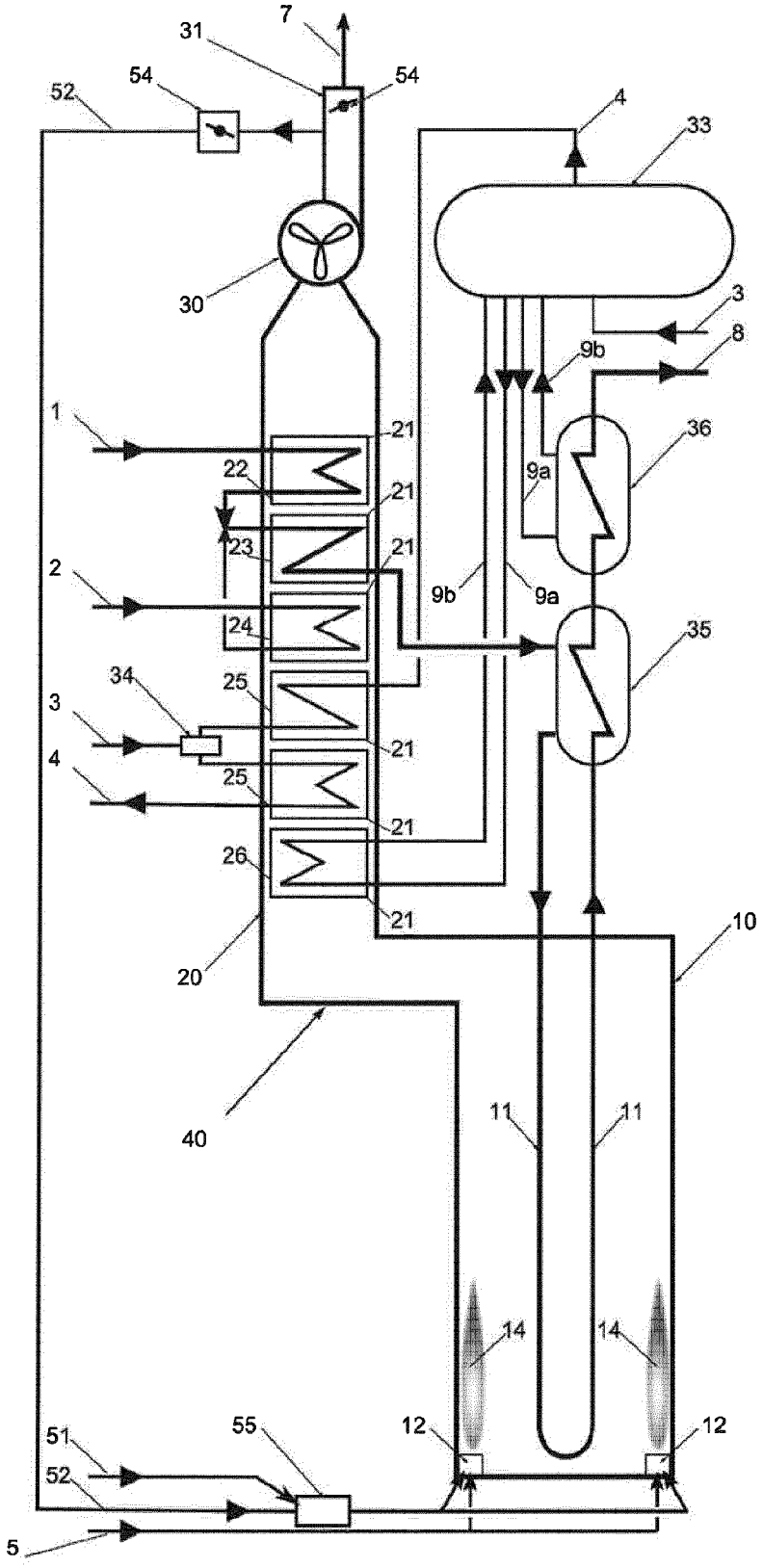
FIG. 6 shows a schematic representation of a sixth embodiment of a cracking furnace system according to the invention.

FIG. 6 shows a schematic representation of a sixth embodiment of a cracking furnace system. In this embodiment, heat for the pyrolysis reaction in the furnace firebox 10 is provided by fuel (gas) 5 and highly nitrogen depleted combustion oxygen 51 fired in the burners 12 in the presence of externally recirculating flue gas 52. This scheme is practically the same as the one presented in FIG. 5, except that all the combustion air 6 is replaced by combustion oxygen 51. This is the scheme with the highest consumption of combustion oxygen 51, but the lowest quantity of flue gas leaving the stack. This flue gas is very rich in CO2 making it ideal for carbon capturing, and the NOx emission is the lowest due to the absence of nitrogen, except for the nitrogen associated with air leakage into the convection section. This scheme is the most environmentally friendly.

Figure 8:
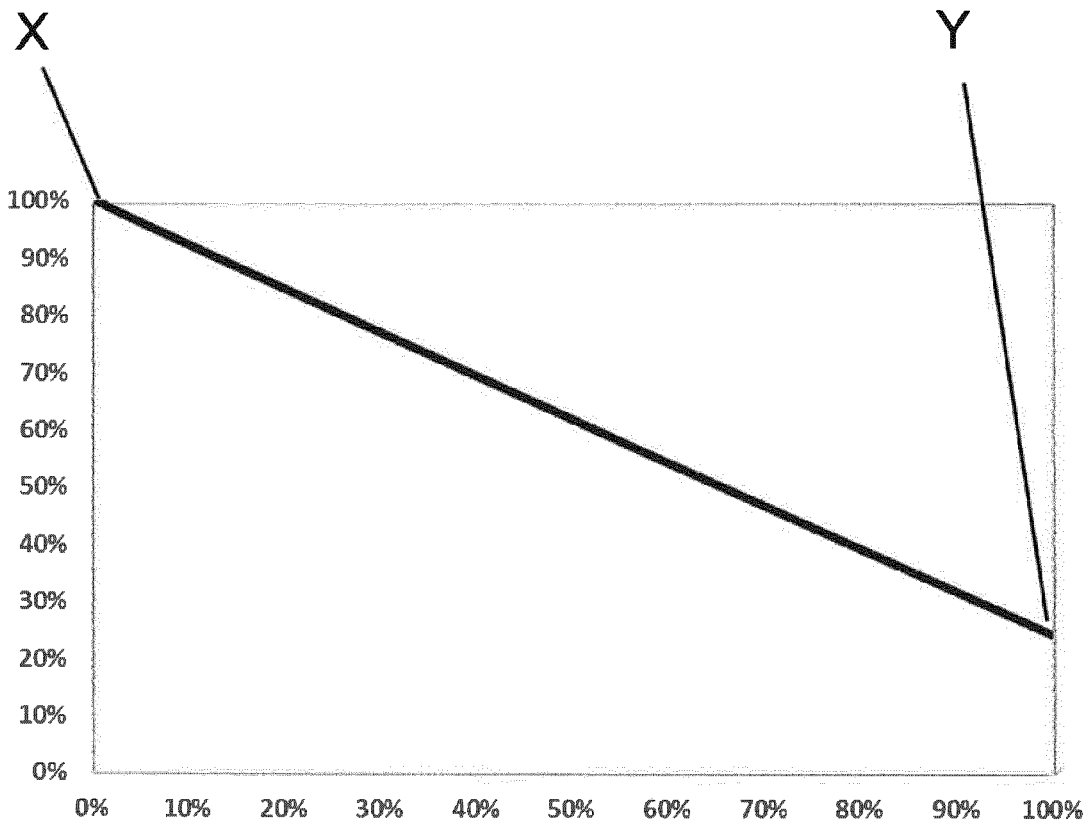
FIG. 8 shows a graph representing relative oxygen flow rate versus relative air flow rate.

The relation between FIGS. 4, 5 and 6 can be further explained with reference to FIG. 8, the graph showing the relative oxygen flow rate (on the vertical axis) as a function of relative air flow rate (on the horizontal axis). The relative oxygen flow rate is the flow rate relative to the oxygen requirement at 100% oxy-fuel combustion, i.e. in the absence of any combustion air. FIG. 4 is a schematic representation of a cracking furnace system for partial oxy-fuel combustion without any need for external flue gas recirculation, while FIG. 6 is a schematic representation of a cracking furnace system for full oxy-fuel combustion with external flue gas recirculation to temper the adiabatic flame temperature. FIG. 5 is a schematic representation of a cracking furnace system for an intermediate situation. The oxygen requirement relative to full oxy-fuel combustion as shown in FIG. 6 is 25% for the scheme as shown in FIG. 4 as one extreme, indicated by "y" in the graph, and 100% for the FIG. 6 scheme, which is indicated as "x" in the graph of FIG. 8. The FIG. 5 scheme is in between these two extremes. The FIG. 6 scheme produces the lowest NOx of the three schemes, lower than that of current state-of-the-art schemes, while the FIG. 4 scheme has a substantially higher NOx emission level than the other two schemes. The FIG. 5 scheme is in between these two extremes. The FIG. 4 scheme may be the most economical of the three schemes if there is no requirement for carbon capturing, but only for better fuel efficiency. As mentioned before, the FIG. 6 scheme may be the most environmentally friendly and suitable for carbon capturing. The introduction of combustion air can provide a significant reduction of the need for oxygen, the oxygen requirement reducing from 100% to approximately 25% as a function of the relative air flow. For the FIG. 6 scheme the relative oxygen flow rate is 100%, and for the FIG. 4 scheme this is approximately 25%. The FIG. 5 scheme is in between these two extremes. The relative air flow rate is the flow rate relative to the combustion air requirement at partial oxy-fuel combustion as per FIG. 4 scheme, at approximately 7 wt % oxygen injection to raise the adiabatic flame temperature and no external flue gas recirculation. In the FIG. 6 scheme the relative combustion air requirement is 0%. The FIG. 5 scheme is in between these two extremes.

Figure 7:
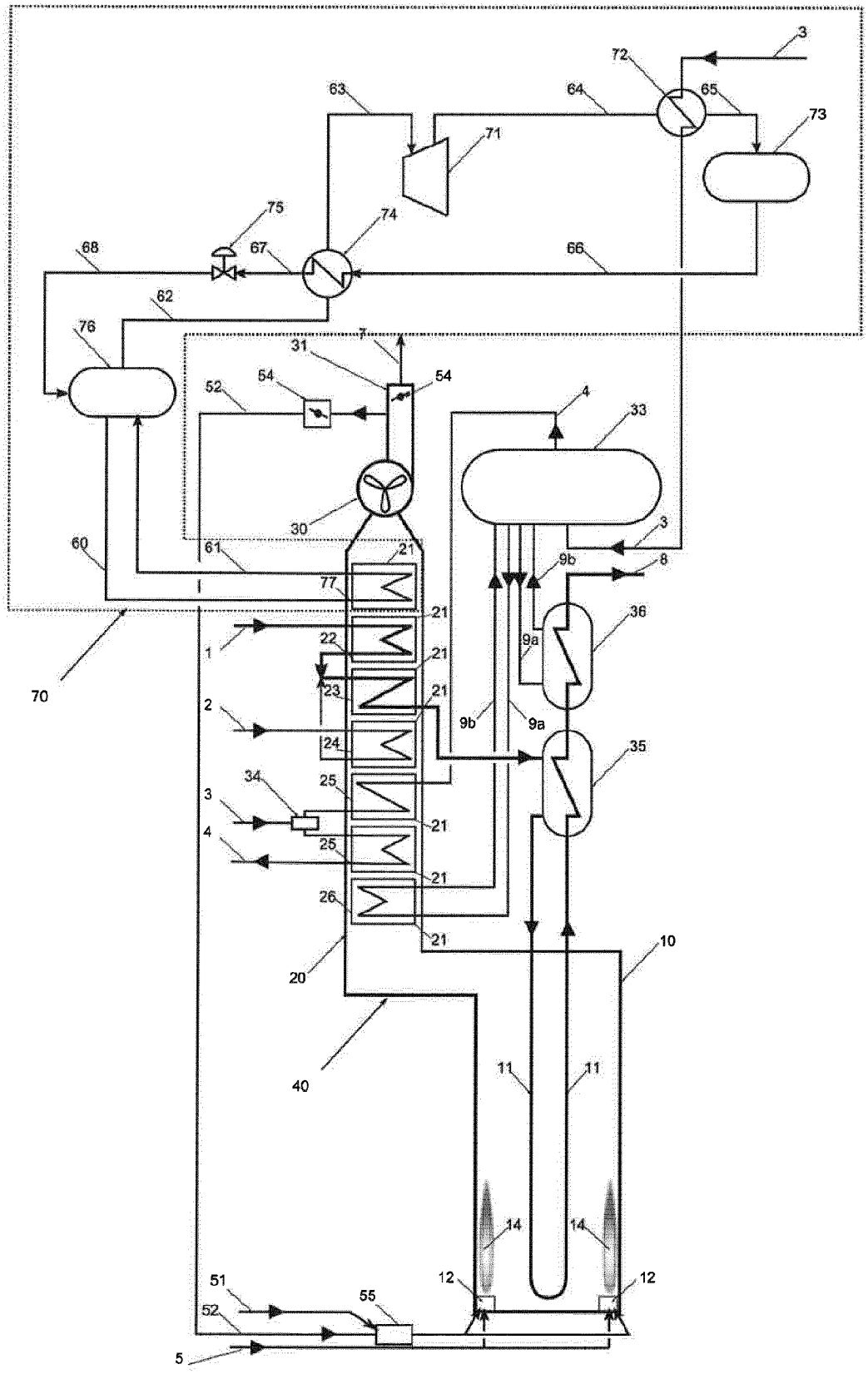
FIG. 7 shows a schematic representation of a seventh embodiment of a cracking furnace system according to the invention.

FIG. 7 shows a schematic representation of a seventh embodiment of a cracking furnace system. This embodiment of the cracking furnace system is based on the embodiment of FIG. 6, thus including a flue gas recirculation circuit with oxygen introduction, and without introduction of combustion air. In order to further increase the furnace efficiency, a heat pump circuit 70 is added to the system 40. The heat pump circuit 70 is configured to recover heat from the flue gas and use it to preheat boiler feed water thus increasing the production of high pressure steam. The heat source of the heat pump circuit 70 comprises an evaporator coil 77 located in the convection section 20 of the cracking furnace 40. This evaporator coil 77 is connected to a vapour-liquid separating device 76, such as for example a knock-out drum, via down comers and risers. Organic fluid 60, such as for example butane, pentane or hexane, is flowing under natural circulation via the down comers to the evaporator coil 77 where it is partially evaporated by the heat recovered from the flue gas. The organic liquid/vapour mixture 61 is flowing back to the vapour-liquid separating device via the risers. In the vapour-liquid separating device the vapour 62 is separated from the liquid/vapour mixture 61. The vapour 62 separated from the mixture 61 is then superheated in a feed effluent exchanger 74 in order to increase loop efficiency. The superheated vapour 63 is sent to a compressor 71. This compressor 71 is configured to raise the pressure of the superheated vapour 63 to such a level that the condensing temperature at the outlet of the compressor 71 exceeds with sufficient margin the temperature level to which the boiler feed water 3 needs to be preheated. This requires a proper selection of the compressor efficiency. The compressed high pressure vapour 64 from the compressor 71 is fully condensed in the condenser 72. The condensation heat is used to preheat boiler feed water 3. The condensed organic liquid 65 is accumulated in the condensate vessel 73. From the condensate vessel 73 the saturated liquid 66 is sent to the feed effluent exchanger 74 to be subcooled. The subcooled liquid 67 is flashed to a lower pressure in a pressure reduction valve 75. The more the liquid is subcooled in the feed effluent exchanger 74, the higher the liquid fraction at the outlet of this valve 75 and the lower the required circulation rate of the organic heat pumped fluid. The low pressure liquid vapour mixture 68 is sent to the vapour-liquid separating device 76, where the liquid and vapour are separated from each other, completing the circuit.

Where the evaporator coil 77 is the heat source of the circuit, the condenser 72 can be considered as the heat sink of the circuit. The duty that needs to be condensed in the condenser 72 is that of the heat recovered from the flue gas in the evaporator and the heat supplied by a driver of the compressor 71. This means that the power supplied by the driver is also used to generate high pressure steam. This heat improves loop efficiency as no heat is lost in driving the compressor. Yet, it is still beneficial to select a high efficiency compressor and to apply a feed effluent exchanger 74 to keep the flow rate and corresponding equipment size of all items in the circuit as small as possible. In case of a train of cracking furnaces, the compressor 71, the condensate vessel 73 and the feed effluent exchanger 74 can be configured to serve said train of cracking furnaces.

The project leading to this application has received funding from the European Union Horizon H2020 Programme (H2020-SPIRE-2016) under grant agreement n°723706.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim.

Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope of the invention defined in the following claims.

REFERENCES

1. Hydrocarbon feedstock
2. Dilution steam
3. Boiler feed water
4. High pressure steam
5. Fuel gas
6. Combustion air
7. Flue gas
8. Cracked gas
9*a*. Boiler water
9*b*. Partly vapourized boiler water
10. Radiant section/furnace firebox
11. Radiant coil
12. Bottom burner
14. Combustion zone
20. Convection section
21. Convection bank
22. Feed preheater
23. High temperature coil
24. Dilution steam super heater
25. High pressure steam super heater
26. Boiler coil
27. Air preheater
28. Economizer
30. Induced draft fan
31. Stack
33. Steam drum
34. De-super heater
35. Primary transfer line exchanger
36. Secondary transfer line exchanger
37. Forced draft fan
40. Cracking furnace system
50. Preheated combustion air
51. Oxygen
52. Externally recycled flue gas
54. Flue gas splitter
55. Flue gas ejector
60. Organic liquid
61. Organic liquid-vapour mixture
62. Vapour
63. Super heated vapour
64. High pressure vapour
65. Condensed organic liquid
66. Saturated liquid
67. Subcooled liquid
68. Low pressure liquid-vapour mixture
70. Heat pump circuit
71. Compressor
72. Condenser
73. Condensate vessel
74. Feed effluent exchanger
75. Pressure reduction valve
76. Vapour-liquid separating device
77. Evaporator coil

The invention claimed is:

1. Cracking furnace system for converting a hydrocarbon feedstock into cracked gas comprising:
a convection section;
a radiant section; and
a cooling section, wherein the convection section includes a plurality of convection banks configured to receive and preheat hydrocarbon feedstock, wherein the radiant section includes a firebox comprising at least one radiant coil configured to heat up the feedstock to a temperature allowing a pyrolysis reaction, wherein the cooling section includes at least one transfer line exchanger, wherein the system is configured such that the transfer line exchanger preheats the feedstock before entry into the radiant section using waste heat from cooling down or quenching the cracked gas be a gas-to-gas heat transfer from the cracked gas to the feedstock, and wherein the transfer line exchanger raises feedstock temperature over a majority of a remaining deviation from the temperature allowing the pyrolysis reaction.

2. Cracking furnace system according to claim 1, wherein the convection section comprises a boiler coil configured to generate saturated steam.

3. Cracking furnace system according to claim 1, wherein the convection section is configured for mixing said hydrocarbon feedstock with a diluent, providing a feedstock-diluent mixture, wherein the transfer line exchanger is configured to preheat the feedstock-diluent mixture before entry into the radiant section.

4. Cracking furnace system according to claim 1, further comprising a secondary transfer line exchanger, wherein the secondary transfer line exchanger is configured to generate saturated high pressure steam.

5. Cracking furnace system according to claim 2, further comprising a steam drum which is connected to the boiler coil.

6. Cracking furnace system according to claim 1, wherein the firebox is configured such that a firebox efficiency is higher than at least one of 40%, 45%, or 48%.

7. Cracking furnace system according to claim 1, wherein the convection section comprises an economizer configured to preheat boiler feed water for the generation of saturated steam.

8. Cracking furnace system according to claim 1, wherein the convection section comprises an oxidant preheater, configured to preheat oxidant before introduction of said combustion air into the firebox.

9. Cracking furnace system according to claim 1, wherein the system is configured for oxygen introduction into the radiant section.

10. Cracking furnace system according to claims 1, further comprising an external flue gas recirculation circuit configured to recover at least part of the flue gas and to recirculate said flue gas to the radiant section to control flame temperature.

11. Cracking furnace system according to claim 10, wherein the external flue gas recirculation circuit comprises a flue gas ejector configured to introduce oxygen into the recirculated flue gas prior to entry into the firebox.

12. Cracking furnace system according to claim 1, further comprising a heat pump circuit including an evaporator coil located in the convection section and a condenser, wherein the heat pump circuit is configured such that the evaporator coil recovers heat from the convection section and the condenser transfers said heat to boiler feed water.

13. Cracking furnace system according to claim 2, wherein said boiler coil is located in a bottom part of the convection section.

14. Cracking furnace system according to claim 8, wherein the oxidant preheater is located downstream in the convection section.

15. Cracking furnace system according to claim 9, wherein the system is configured for oxygen introduction into the radiant section in the absence of external flue gas recirculation.

16. Cracking furnace system according to claim 2, further comprising a steam drum which is connected the secondary transfer line exchanger or connected the secondary transfer line exchanger and the boiler coil.

* * * * *